US006037722A

United States Patent [19]

Moisin

[11] Patent Number: 6,037,722

[45] Date of Patent: Mar. 14, 2000

[54] DIMMABLE BALLAST APPARATUS AND METHOD FOR CONTROLLING POWER DELIVERED TO A FLUORESCENT LAMP

[75] Inventor: Mihail S. Moisin, Brookline, Mass.

[73] Assignee: Pacific Scientific, Washington, D.C.

[21] Appl. No.: 08/900,200

[22] Filed: Jul. 25, 1997

Related U.S. Application Data

[63] Continuation-in-part of application No. 08/488,387, Jun. 6, 1995, Pat. No. 5,821,699, which is a continuation-in-part of application No. 08/451,835, May 26, 1995, abandoned, application No. 08/449,786, May 24, 1995, abandoned, application No. 08/316,395, Sep. 30, 1994, abandoned, and application No. 08/723,289, Sep. 30, 1996, Pat. No. 5,691,606, which is a continuation of application No. 08/316,395, Sep. 30, 1994, abandoned.

[60] Provisional application No. 60/044,929, Apr. 25, 1997.

[51] Int. Cl.[7] ..... H05B 37/02

[52] U.S. Cl. ..... 315/307; 315/224; 315/291; 315/DIG. 4

[58] Field of Search ..... 315/307, 209 R, 315/291, 224, 247, 244, DIG. 4, DIG. 5, DIG. 7, 308, 297, 310, 225, 119, 277

[56] References Cited

U.S. PATENT DOCUMENTS

| | | | |
|---|---|---|---|
| 2,505,112 | 4/1950 | Hallman | 173/328 |
| 2,966,602 | 12/1960 | Waymouth et al. | 313/44 |
| 3,112,890 | 12/1963 | Snelling | 240/51.11 |
| 3,517,259 | 6/1970 | Dotto | 315/200 |
| 3,569,817 | 3/1971 | Boehringer | 321/2 |
| 3,611,021 | 10/1971 | Wallace | 315/239 |
| 3,736,496 | 5/1973 | Lachocki | 323/227 |
| 3,882,356 | 5/1975 | Stehlin | 315/205 |

(List continued on next page.)

FOREIGN PATENT DOCUMENTS

| | | |
|---|---|---|
| 0114370 | 8/1984 | European Pat. Off. . |
| 0127101 | 12/1984 | European Pat. Off. . |
| 0239863 | 10/1987 | European Pat. Off. . |
| 0395776 | 11/1990 | European Pat. Off. . |
| 0441253 | 8/1991 | European Pat. Off. . |
| 3437554 | 4/1986 | Germany . |
| 0259646 | 3/1988 | Germany . |
| 3632272 | 4/1988 | Germany . |
| 3813672 | 11/1988 | Germany . |
| 655042 | 12/1976 | Russian Federation . |
| 9000830 | 1/1990 | WIPO . |
| 9009729 | 8/1990 | WIPO . |
| 9309649 | 5/1993 | WIPO . |
| 94/27420 | 11/1994 | WIPO . |

OTHER PUBLICATIONS

Kröning, et al., "New Electronic Control Gear," *Siemens Power Engineering & Automation VII*, No. 2, pp. 102–104 1985.

Hayt, et al., *Engineering Circuit Analysis*, 3d ed., pp. 296–297, 1978.

OSRAM DELUX® compact fluorescent lamps, "Economical long–lift lighting—with extra convenience of electronic control gear", pp. 1–15.

Philips Lighting, "Lamp specification and application guide", pp. 1, 11, 61–64, 78.

*Primary Examiner*—Don Wong
*Assistant Examiner*—Wilson Lee
*Attorney, Agent, or Firm*—Knobbe, Martens, Olson & Bear, LLP

[57] ABSTRACT

A dimmable electronic ballast for a gas discharge lamp utilizing a modified self-resonant split inductor configuration. The voltage supplied to the lamp load is controlled by varying the duty cycle of the output stage which, in turn, feeds back a driving signal to the boost converter to synchronize the DC voltage with the needs of the load. The circuit also performs power factor and THD control. The ballast circuit controls the start-up of the lamp by proving a warming current to the filaments and then boosts the voltage to strike the lamps. If the lamps are at end-of-life wherein the filaments are intact but vapor and coatings are diminished, the ballast will apply bursts of higher voltage until the lamp strikes. Additionally, if the filaments are open, the circuit stops operation.

16 Claims, 5 Drawing Sheets

U.S. PATENT DOCUMENTS

| | | | |
|---|---|---|---|
| 3,913,000 | 10/1975 | Cardwell, Jr. | 321/2 |
| 3,965,345 | 6/1976 | Fordsmand | 240/47 |
| 3,974,418 | 8/1976 | Fridrich | 315/59 |
| 4,005,334 | 1/1977 | Andrews | 315/208 |
| 4,016,451 | 4/1977 | Engel | 315/158 |
| 4,053,813 | 10/1977 | Kornrumpf et al. | 315/206 |
| 4,125,767 | 11/1978 | Silver | 250/214 P |
| 4,127,795 | 11/1978 | Knoll | 315/210 |
| 4,127,798 | 11/1978 | Anderson | 315/209 R |
| 4,135,116 | 1/1979 | Smith | 315/158 |
| 4,160,288 | 7/1979 | Stuart et al. | 363/41 |
| 4,168,453 | 9/1979 | Gerhard et al. | 315/225 |
| 4,230,971 | 10/1980 | Gerhard et al. | 315/307 |
| 4,237,403 | 12/1980 | Davis | 315/98 |
| 4,245,285 | 1/1981 | Weiss | 363/17 |
| 4,277,728 | 7/1981 | Stevens | 315/307 |
| 4,284,925 | 8/1981 | Bessone et al. | 315/240 |
| 4,348,615 | 9/1982 | Garrison et al. | 315/219 |
| 4,350,891 | 9/1982 | Wuerflein | 378/110 |
| 4,353,009 | 10/1982 | Knoll | 315/220 |
| 4,370,600 | 1/1983 | Zansky | 315/244 |
| 4,379,254 | 4/1983 | Hurban | 315/291 |
| 4,388,563 | 6/1983 | Hyltin | 315/205 |
| 4,392,087 | 7/1983 | Zansky | 315/219 |
| 4,393,323 | 7/1983 | Hubner | 313/110 |
| 4,395,660 | 7/1983 | Waszkiewicz | 315/291 |
| 4,399,391 | 8/1983 | Hammer et al. | 315/244 |
| 4,423,348 | 12/1983 | Greiler | 313/113 |
| 4,443,740 | 4/1984 | Goralnik | 315/284 |
| 4,481,460 | 11/1984 | Kröning et al. | 323/266 |
| 4,510,400 | 4/1985 | Kiteley | 307/66 |
| 4,523,131 | 6/1985 | Zansky | 315/307 |
| 4,533,986 | 8/1985 | Jones | 363/17 |
| 4,544,863 | 10/1985 | Hashimoto | 315/209 R |
| 4,547,706 | 10/1985 | Krummel | 315/226 |
| 4,562,383 | 12/1985 | Kerscher et al. | 315/225 |
| 4,580,080 | 4/1986 | Smith | 315/199 |
| 4,612,479 | 9/1986 | Zansky | 315/194 |
| 4,613,934 | 9/1986 | Pacholok | 363/131 |
| 4,616,158 | 10/1986 | Krummel et al. | 315/225 |
| 4,620,271 | 10/1986 | Musil | 363/21 |
| 4,626,746 | 12/1986 | Zaderej | 315/208 |
| 4,631,450 | 12/1986 | Lagree et al. | 315/244 |
| 4,641,061 | 2/1987 | Munson | 315/210 |
| 4,647,817 | 3/1987 | Fähnrich et al. | 315/104 |
| 4,651,060 | 3/1987 | Clark | 315/199 |
| 4,677,345 | 6/1987 | Nilssen | 315/209 R |
| 4,682,083 | 7/1987 | Alley | 315/307 |
| 4,683,402 | 7/1987 | Aubrey | 315/56 |
| 4,700,113 | 10/1987 | Stupp et al. | 315/224 |
| 4,730,147 | 3/1988 | Kroening | 315/100 |
| 4,739,227 | 4/1988 | Anderson | 315/260 |
| 4,742,535 | 5/1988 | Hino et al. | 378/105 |
| 4,743,835 | 5/1988 | Bossé et al. | 323/266 |
| 4,857,806 | 8/1989 | Nilssen | 315/72 |
| 4,859,914 | 8/1989 | Summa | 315/354 |
| 4,864,482 | 9/1989 | Quazi et al. | 363/37 |
| 4,894,587 | 1/1990 | Jungreis et al. | 315/200 R |
| 4,933,605 | 6/1990 | Quazi et al. | 315/224 |
| 4,943,886 | 7/1990 | Quazi et al. | 361/42 |
| 4,949,020 | 8/1990 | Warren et al. | 315/297 |
| 4,950,963 | 8/1990 | Sievers | 315/360 |
| 4,954,768 | 9/1990 | Luchaco et al. | 323/300 |
| 4,988,921 | 1/1991 | Ratner et al. | 315/159 |
| 4,996,462 | 2/1991 | Krummel | 315/209 R |
| 4,999,547 | 3/1991 | Ottenstein | 315/307 |
| 5,001,386 | 3/1991 | Sullivan et al. | 315/219 |
| 5,003,230 | 3/1991 | Wong et al. | 315/279 |
| 5,004,959 | 4/1991 | Nilssen | 315/291 |
| 5,004,972 | 4/1991 | Roth | 323/320 |
| 5,039,914 | 8/1991 | Szuba | 315/158 |
| 5,041,763 | 8/1991 | Sullivan et al. | 315/176 |
| 5,083,081 | 1/1992 | Barrault et al. | 324/126 |
| 5,084,653 | 1/1992 | Nilssen | 315/219 |
| 5,089,751 | 2/1992 | Wong et al. | 315/279 |
| 5,097,181 | 3/1992 | Kakitani | 315/209 R |
| 5,101,142 | 3/1992 | Chatfield | 315/308 |
| 5,172,033 | 12/1992 | Smits | 315/224 |
| 5,172,034 | 12/1992 | Brinkerhoff | 315/307 |
| 5,173,643 | 12/1992 | Sullivan et al. | 315/276 |
| 5,174,646 | 12/1992 | Siminovitch et al. | 362/218 |
| 5,175,477 | 12/1992 | Grissom | 315/291 |
| 5,185,560 | 2/1993 | Nilssen | 315/219 |
| 5,192,896 | 3/1993 | Qin | 315/224 |
| 5,194,782 | 3/1993 | Richardson et al. | 315/291 |
| 5,198,726 | 3/1993 | Van Meurs et al. | 315/224 |
| 5,214,356 | 5/1993 | Nilssen | 315/224 |
| 5,233,270 | 8/1993 | Nilssen | 315/58 |
| 5,237,243 | 8/1993 | Chung | 315/219 |
| 5,245,253 | 9/1993 | Quazi | 315/224 |
| 5,289,079 | 2/1994 | Wittman | 313/318 |
| 5,289,083 | 2/1994 | Quazi | 315/224 |
| 5,296,783 | 3/1994 | Fischer | 315/64 |
| 5,309,062 | 5/1994 | Perkins et al. | 315/53 |
| 5,313,142 | 5/1994 | Wong | 315/205 |
| 5,321,337 | 6/1994 | Hsu | 315/219 |
| 5,331,253 | 7/1994 | Counts | 315/209 R |
| 5,341,067 | 8/1994 | Nilssen | 315/209 R |
| 5,363,020 | 11/1994 | Chen et al. | 315/224 |
| 5,394,064 | 2/1995 | Ranganath et al. | 315/209 R |
| 5,396,154 | 3/1995 | Shiy et al. | 315/291 |
| 5,396,155 | 3/1995 | Bezdon et al. | 315/291 |
| 5,404,082 | 4/1995 | Hernandez et al. | 315/219 |
| 5,434,478 | 7/1995 | Kovalsky et al. | 315/209 R |
| 5,440,475 | 8/1995 | Russell et al. | 315/209 R |
| 5,461,287 | 10/1995 | Russell et al. | 315/209 R |
| 5,550,438 | 8/1996 | Reijnaerts | 315/219 |
| 5,596,247 | 1/1997 | Martich et al. | 315/56 |
| 5,751,115 | 5/1998 | Jayaraman et al. | 315/225 |
| 5,850,127 | 12/1998 | Zhu et al. | 315/224 |

DIMMABLE BALLAST APPARATUS AND METHOD FOR CONTROLLING POWER DELIVERED TO A FLUORESCENT LAMP

RELATED APPLICATIONS

The present application is a continuation-in-part of U.S. patent application Ser. No. 08/488,387, filed on Jun. 6, 1995, now U.S. Pat. No. 5,821,699 which is a continuation-in-part of U.S. patent application Ser. No. 08/451,835, filed on May 26, 1995 (abandoned), and a continuation-in-part of U.S. patent application Ser. No. 08/449,786, filed on May 24, 1995 (abandoned), and a continuation-in-part of U.S. patent application Ser. No.08/316,395, filed on Sep. 30, 1994 (abandoned), and a continuation-in-part of U.S. patent application Ser. No. 08/723,289, filed on Sep. 30, 1996, now U.S. Pat. No. 5,691,606 which is a continuation of U.S. patent application Ser. No. 08/316,395, filed on Sep. 30 1994 (abandoned). The present application also claims priority from U.S. Provisional Patent Application No. 60/044,929 filed on Apr. 25, 1997. The contents of those applications, in their entirety, are hereby incorporated by reference.

BACKGROUND OF THE INVENTION

1. Field of the Invention

The present invention relates to an improved apparatus and method for operating and dimming fluorescent lamps and, in particular, to a method and apparatus to control the power delivered to a fluorescent lamp when receiving input power from a source utilizing a remote incandescent lamp dimming control.

2. Description of the Prior Art

Fluorescent lamps are conventional types of lighting devices. They are gas charged devices which provide illumination as a result of atomic excitation of a low-pressure gas, such as mercury, within a lamp envelope. The excitation of the mercury vapor atoms is provided by a pair of heater filament elements mounted within the lamp at opposite ends of the lamp envelope. These heater filament elements are coated with a material which emits electrons when excited by an electric current. In order to properly excite the mercury vapor atoms, the lamp is ignited or struck by a higher than normal voltage. Upon ignition of the lamp, the impedance of the lamp decreases and the voltage across the lamp drops to the operating level at a relatively constant current. The excited mercury vapor atoms emit invisible ultraviolet radiation which in turn excites a fluorescent lamp material, e.g., phosphor, that is deposited on an inside surface of the fluorescent lamp envelope, thus converting the invisible ultraviolet radiation to visible light. The fluorescent lamp coating material is selected to emit visible radiation over a wide spectrum of colors and intensities.

Fluorescent lamps have substantial advantages over conventional incandescent lamps. In particular, the fluorescent lamps are substantially more efficient and typically use 80 to 90% less electrical power than incandescent lamps for an equivalent light output. For this reason, fluorescent lamps have gained use in a wide range of power sensitive applications.

As is known to those skilled in the art, a ballast circuit is commonly disposed in electrical communication with the fluorescent lamp to provide the elevated voltage levels and the constant current required for fluorescent lamp illumination. Typical ballast circuits electrically connect the fluorescent lamp to line alternating current and convert this alternating current provided by the power transmission lines to the constant current an voltage levels required by the lamp.

To strike or light a fluorescent lamp, a high voltage level is required rather than high power. As a means of resolving the high power loss inherent in the design of electromagnetic ballasts, solid state designs have evolved. The present invention improves the efficiency of the electronic ballast and controls the dimming level through the incorporation of a novel series of feed forward and feedback control methods to tightly couple and control the power boost and Modified Self Resonant Load Driving Stages. In addition, many electronic fluorescent lamp ballasts are unable to work with conventional triac dimming switches as the leading edge phase control results in the ballast being unable to draw enough current to keep the triac firing. This is particularly true at lower dimming levels where sinking sufficient current to keep the triac firing and start the lamps is particularly difficult. The present invention resolves this problem.

Existing dimming ballast devices utilize a four wire arrangement to supply power and provide a dimming signal to control the lamps. This limits these ballasts to new installations. The present invention resolves this limitation and derives both power and dimming information from existing wiring when in communication with standard incandescent lamp 2-wire triac controlled dimming controls.

Additionally, at the end of a lamp's life-cycle, the voltage required to strike the lamp increases. This results in the lamp not lighting because the peak voltage required to strike the lamp cannot be provided by existing electromagnetic and electronic ballast designs. Also, low temperatures require a higher voltage to strike the lamp. This is due to the greater thermal gradient between the environmental temperature and that necessary to ignite the lamp. This limits the environmental operating range of current ballast designs, making them unusable at low wintertime temperatures. The present invention addresses the ability to extend the useful life of fluorescent lamps and provide improved cold starting capability.

Product safety considerations dictate that the circuit not operate when a lamp filament fails or the lamp is removed. Many designs require that when lamps are hot changed or fail that the circuit be reset. The present invention addresses these issues by providing a means to inhibit operation of the circuit when these conditions exist and immediately return to operating status when the fault condition is corrected, i.e., a functioning lamp is placed in communication with the ballast.

OBJECTS OF THE INVENTION

Several objects and advantages of the present invention include:

a. Providing a fluorescent lamp ballast capable of communicating with a standard incandescent lamp triac control by means of a 2-wire circuit.

b. Providing a fluorescent lamp ballast capable of drawing sufficient current at low dimming levels to assure the required current flow for continuous firing of the remote triac in the dimming control.

c. Providing a fluorescent lamp ballast having a high frequency operating voltage.

d. Providing a fluorescent lamp ballast having an adaptive lamp striking means.

e. Providing a fluorescent lamp ballast having a fluorescent lamp protection circuit means which creates bursts of high voltage high frequency pulses to extend the end of life of a fluorescent lamp having an intact heater filament.

f. Providing a fluorescent lamp ballast having a circuit means for limiting current draw by the fluorescent lamp heater filament to prevent catastrophic lamp failure.

g. Providing a fluorescent lamp ballast having a circuit means to detect a missing lamp or open heater filament to prevent operation of the Modified Self Resonant Load Driving Stage.

h. Providing a fluorescent lamp ballast having a circuit means to control the dimming level of the Modified Self Resonant Load Driving Stage using a feed-forward control means.

i. Providing a fluorescent lamp ballast having a circuit means to synchronously control the boost and Modified Self Resonant Load Driving Stages using a feedback control means.

Additional objects will be obvious to those skilled in the art from the drawings and detailed description which follows:

SUMMARY OF THE INVENTION

The present invention provides the ability of a fluorescent lamp ballast to work in conjunction with remote incandescent lamp triac controlled dimmers utilizing leading edge A.C. phase control technology. These dimmers are generally used with incandescent lighting. The circuit achieves this end through maintenance of sufficient current flow through the triac to promote continued firing of the device even at low dimming levels.

A split inductor series resonant parallel loaded circuit configuration is used in the fluorescent lamp striking and operating mode circuitry. This split inductor configuration beneficially generates a higher striking voltage to promote superior end of life and cold lamp starting and is arranged to allow the functional disablement of the added inductance during normal operation. The ballast circuit utilizes a fluorescent lamp striking scenario which first warms the heater filaments for a defined time period by severely limiting the conduction angle of one half of the half-bridge inverter and then applying a high frequency high voltage to strike the lamp load. Should the lamp have intact filaments but fail to strike due to end of life or low temperature conditions, the voltage across the load will start to increase. This will activate a second circuit control path which will cause a diac to break down and conduct. This will attempt to strike the lamp load by generating a sequence of high frequency high voltage pulses which will cause the heater filaments to quickly strike the lamp even at the end of lamp life when the filament coating has diminished. The striking process is timed and will repeat until the lamp strikes. Moreover, when the impedance is low, a condition which exists after lamp striking, the circuit stops firing. When the load impedance is high and no current flow is sensed, a condition that exists when the heater filament fails or the lamp has been removed, the output circuit is disabled.

The input circuit has a positive temperature coefficient thermistor to assure that sufficient current is drawn at low dimming levels from the dimming control. A path to handle the startup surge, lightening surge, and over voltage when the boost converter is in continuous mode is provided. The boost converter facilitates reliable operation by assuring that sufficient current is drawn from the triac control at low dimming levels to assure continuing operation and also significantly reduces the DC ripple thereby eliminating lamp flicker.

The present invention accomplishes the dimming function by controlling the power delivered to the lamp load. Additionally, through the use of a unique feed forward means, the ability of the triac dimming control to supply current to the ballast system is balanced with respect to the current requirement of the load. Secondly, a novel feedback control means linking the power boost and Modified Self Resonant Load Driving Stages of the circuitry assures that the two stages operate synchronously. This controls the supply voltage to the output stage assuring continuous dimming over a wide range of input voltage.

DETAILED DESCRIPTION OF THE PREFERRED EMBODIMENT

The present invention is a fluorescent lamp ballast suitable for driving a fluorescent lamp from an AC power source having a remote triac phase controlled dimming control. the circuit is self-resonating and self-controlling through the use of feed forward and feedback signal paths.

Figure 1:
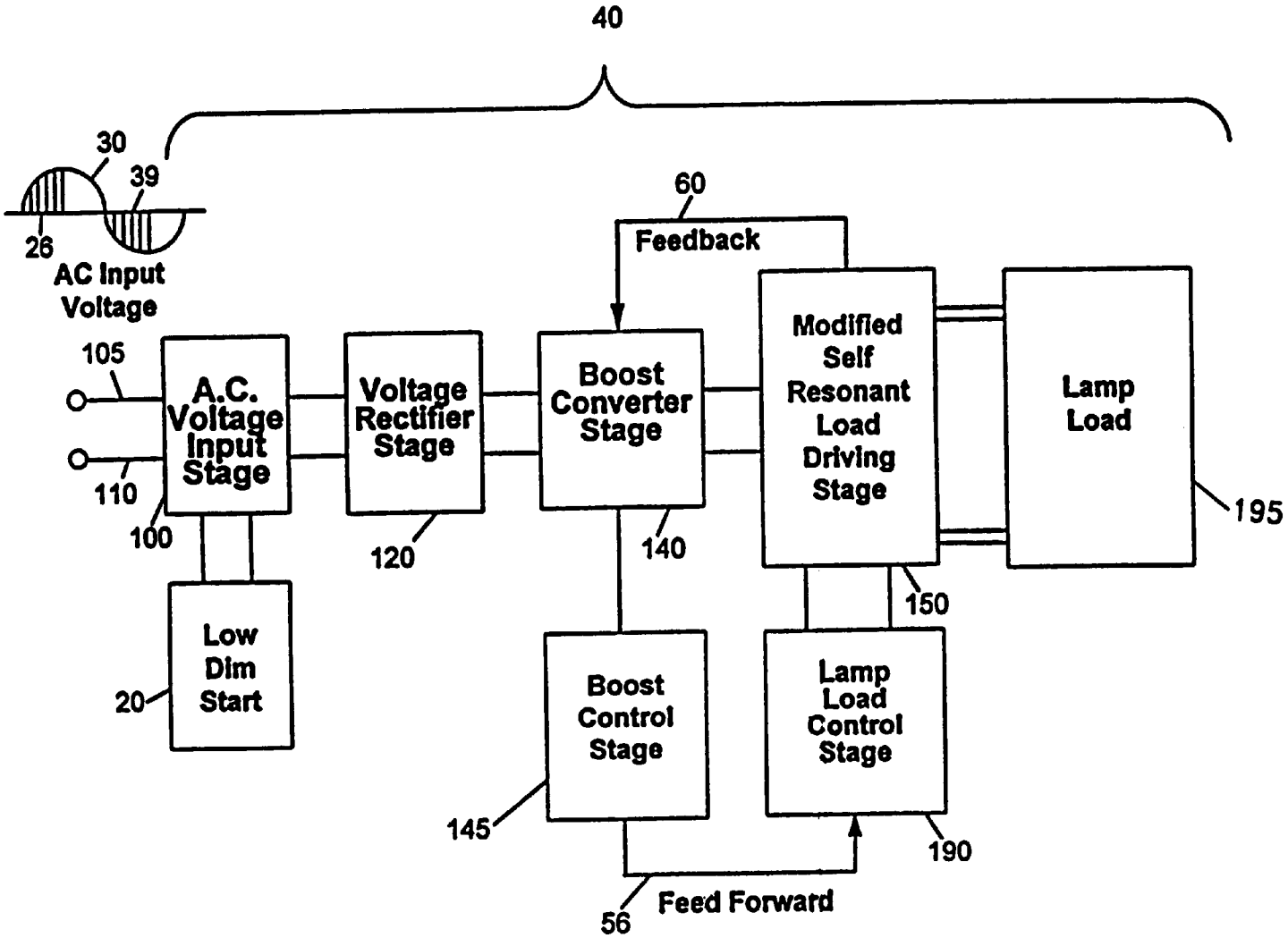
FIG. 1 is a schematic block diagram of a dimmable ballast circuit for use with incandescent lamp dimming controls.

FIG. 1 illustrates an exemplary schematic block diagram of a fluorescent lamp system in accordance with the present invention.

The ballast circuit 40 includes an A.C. Voltage Input stage 100, a Voltage Rectifier Stage 120, a Low Dim Start Stage 20, a Boost Converter Stage 140, a Boost Control Stage 145, a Modified Self Resonant Load Driving Stage 150, a Lamp Load Control Stage 190 and a Lamp Load 195.

The input power supply high and low voltage lines 105 and 110 are connected electrically in series with the A.C. Voltage Input Stage 100. The output of the A.C. Voltage Input Stage 100 is connected to the Voltage Rectifier Stage 120 which in turn is connected to the Boost Converter Stage 140. The output of the Boost Converter Stage 140 is connected to the input of the Modified Self Resonant Load Driving Stage 150 which in turn is connected to the lamp load 195. Finally the Lamp Load Control Stage 190 is connected to the Modified Self Resonant Load Driving Stage 160 and the boost control stage 145 is connected between the boost converter stage 140 and the lamp load control stage 190.

Additionally, FIG. 1 depicts two control loops which control and synchronize the operation of the Boost Converter Stage 140 and Modified Self Resonant Load Driving Stage 150. A feedback signal 60 synchronizes the on and off times of the two stages, while feed forward signal 56 balance the ability of the SCR control to supply current with the need of the lamp load.

Figure 2A:
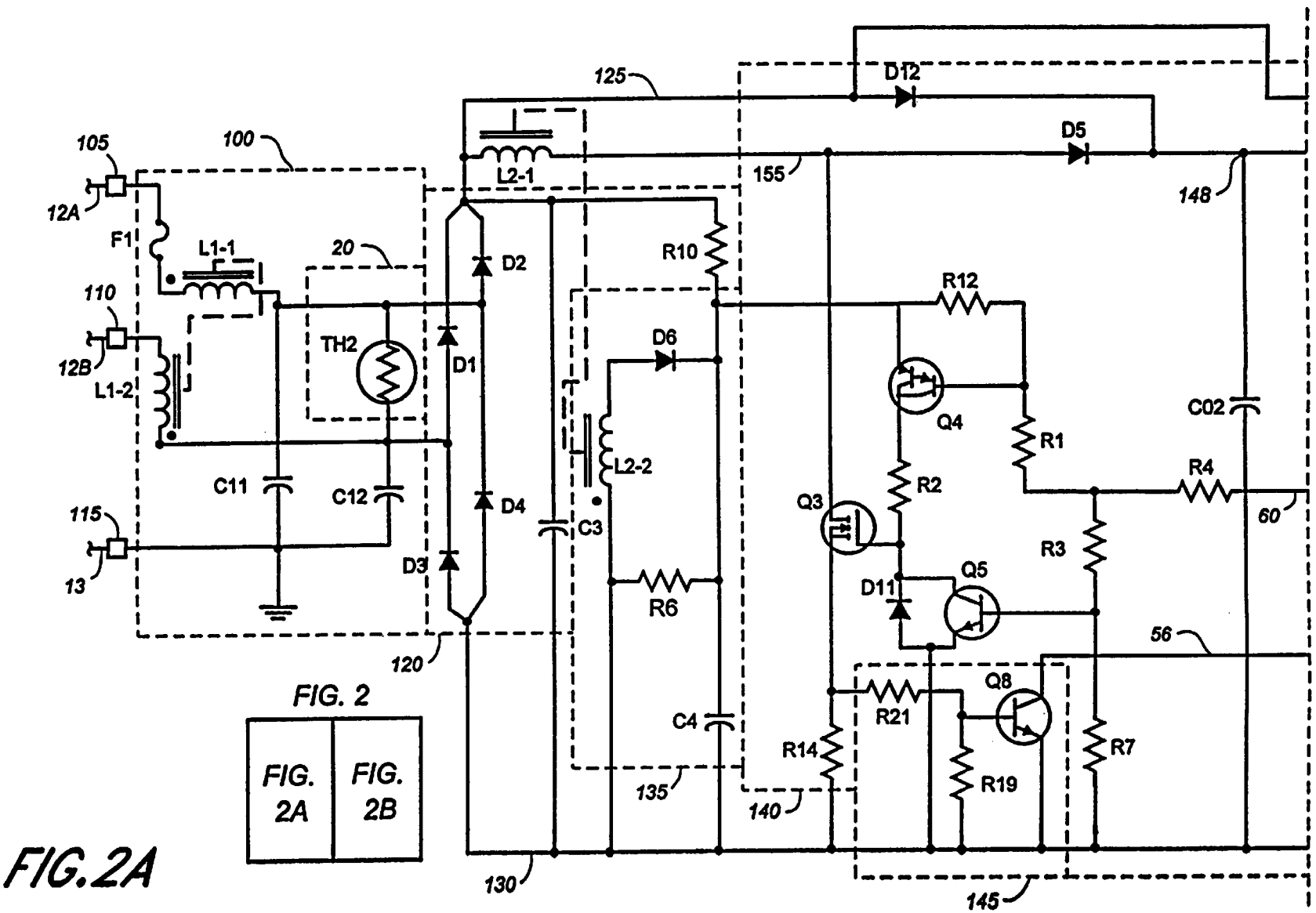
FIG. 2 is a schematic circuit illustration of the ballast circuitry of FIG. 1, showing a two-lamp fluorescent lamp load.
Figure 2B:
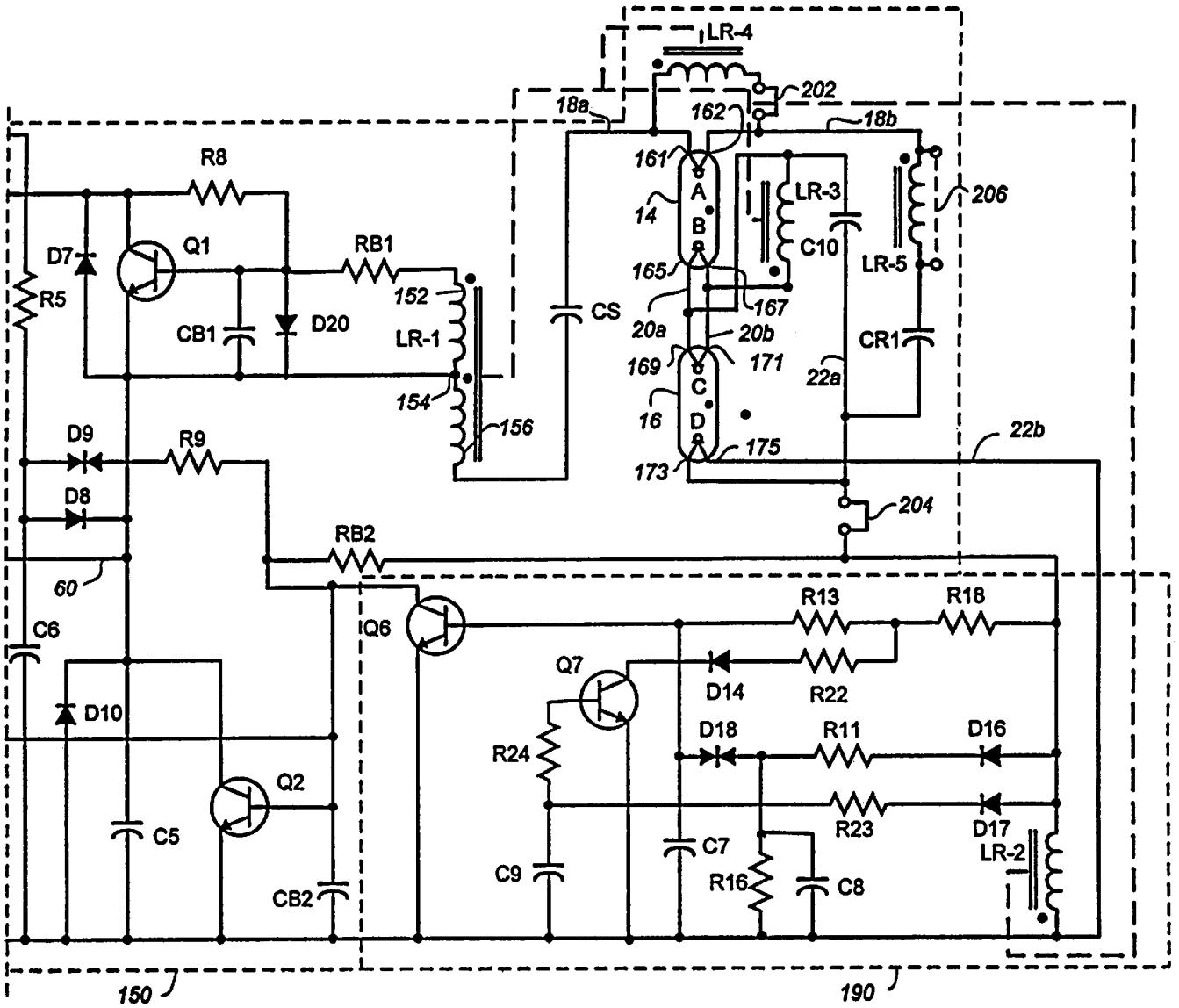

FIG. 2 depicts one preferred embodiment of an externally dimmable ballast circuit 40, as schematically shown in the block diagram of FIG. 1. The ballast circuit includes an EMI stage 100 that is connected between the input power leads 12*a* and 12*b*. The EMI stage 100 includes a pair of series inductors L1-1 and L1-2, a fuse F1 and a pair of parallel capacitors C11 and C12. The fuse F1 has a first end connected to the high side of the AC line 12A and a second end electrically connected in series with the first end of the high frequency blocking inductor L1-1. The second terminal of inductor L1-1 is connected to one end of capacitor C11 and the input to a first pair of diodes of the rectification stage 120. The second end of capacitor C11 is connected to earth ground 13. The neutral side of the AC line 12B is connected to a first end of the high frequency blocking inductor L1-2. The second terminal of inductor L1-2 is connected to one end of capacitor C12 and the input to a second pair of diodes of the rectification stage 120. The second end of capacitor C12 is connected to earth ground 13.

The low dim start stage 20 is comprised of a positive temperature coefficient thermistor TH2. The thermistor TH2 has a low resistance at start, thereby drawing sufficient current to assure continued firing of the triac dimming control even at low dimming levels. As the thermistor TH2 warms up due to $I^2R$ heating, its resistance increase and the current draw decreases. The continued ability to draw sufficient current from the triac control is assumed by the boost converter stage 140.

The rectification stage 120 is comprised of rectification diodes D1 through D4, a capacitor C3, and a current limiting resistor R10. The four diodes D1 through D4 form a full wave bridge rectifier with the capacitor C3 acting as a ripple filter. The anode of the diode D1 is connected to the cathode of the diode D3. The junction of diodes D1 and D3 is further connected to the junction of the second end of the inductor L1-2 and the first end of the capacitor C12. The anode of the diode D3 is connected to the anode of the diode D4, the negative voltage rail 130 and a second end of the capacitor C3. The cathode of the diode D4 is connected to the anode of the diode D2 and the junction of the capacitor C11 and the second terminal of the inductor L1-1. The cathode of the diode D2 is connected to the cathode of the diode D1 and the first end of the capacitor C3. The junction of the cathodes of the diodes D2 and D1 further serves as an input to the Boost Converter Stage 140.

A circuit stage 135 serves as a power supply to run the boost converter stage 140. The circuit stage 135 is comprised of an inductor L2-2, a diode D6, a resistor R6, and a filter capacitor C4. Through the magnetically coupled primary inductor L2-1 and secondary inductor L2-2, a DC voltage of approximately 20 volts is generated across the capacitor C4. This voltage is used to run the boost converter circuit. The parallel combination of the resistor R6 and the capacitor C4 provides a filtered load across the inductor L2-2, while the diode D6 assures the direction of current flow.

The first end of the resistor R6 is connected to the capacitor C4, the inductor L2-2 and the negative voltage rail 130. The second end of the resistor R6 and the second end of the capacitor C4 are each connected to the cathode of the diode D6, the collector of the transistor Q4, and a second end of the current limiting resistor R10. The anode of the diode D6 is connected to the second end of the inductor L2-2. Additionally, the first terminal of the inductor L2-1 is connected to the junction of the cathodes of the diodes D1 and D2 and the capacitor C3.

The Boost Converter Stage 140 is comprised of diodes D5, D11, and D12, transistors Q3, Q4, and Q5, resistors R1, R2, R3, R4, R7, and R12, a capacitor C02, and an inductor L2-1. The boost converter stage 140 serves several purposes. The first is to assure continuous operation of the triac dimming control over its entire range. Secondly, the boost converter stage 140 integrates the rectified mains current to eliminate ripple and lamp flicker. The boost converter stage 140 operates synchronously with the Modified Self Resonant Load Driving Stage 150. This is accomplished by a feedback drive signal supplied through the resistor R4 to the junction of resistors R1 and R3. The feedback signal assures that as the power to the load is decreased through control of the Modified Self Resonant Load Driving Stage half bridge transistor Q2, the power delivered to the Modified Self Resonant Load Driving Stage 150 will also be decreased through the synchronized control of the transistor Q3. The reverse is also true. Through this methodology, dimming is accomplished.

The diode D12 provides surge protection for the sensitive components of the ballast circuit 40 and a path for the charging capacitor C02 upon application of power to the ballast circuit 40. The diode D12 also provides a path for the situation when the peak of the line voltage exceeds the voltage across the bulk storage capacitor C02. This happens as the circuit dims and the boost converter stage 140 operation approaches approximately 50 percent duty cycle. Under these conditions, the boost converter stage 140 will alternate between boost and continuous operation on each half cycle. The inductor L2-1 additionally provides a means of sinking sufficient current to assure that the triac in the dimming control will continuously fire even at large leading phase control angles, i.e., low dimming levels as shown in FIG. 1 as item 30. The transistors Q4 and Q5 are arranged in a classical totem pole configuration and provide the gate drive to output power transistors Q3 with Q4 being a PNP transistor and Q5 being an NPN transistor. The resistor R1 in concert with the feedback resistor R4 forms a voltage divider to drive the base of the transistor Q4, while the resistor R2 in concert with the feedback resistor R4 forms a voltage divider to drive the base of the transistor Q5. The resistor R4 serves as a means to synchronize the states of the transistor Q3 of the boost converter stage 140 and the transistor Q2 of the Modified self Resonant Load driving Stage 150. The boost converter stage will not operate unless a feedback driving signal is transmitted to the base of the push-pull pair of transistors Q4 and Q5. The diode D11 protects the gate of the transistor Q3 against negative voltage spikes. The operation of the boost converter charges the capacitor C02 to approximately 320 volts DC which is the input voltage to the Modified Self Resonant Load Driving Stage 150.

The anode of the diode D12 is connected to the first terminal of the inductor L2-1 and a first end of the resistor R5. The cathode of the diode D12 is connected to a first end of the capacitor C02, the cathode of the diode D5, the positive voltage rail 155 and the cathode of the diode D7. The anode of the diode D5 is connected to the second terminal of the inductor L2-1 and the drain of the transistor Q3. The second end of the capacitor C02 is connected to the negative rail 130. The junction of the second end of the resistor R10, the cathode of the diode D6 and the second end of the capacitor C4 are connected to a first end of the resistor R12 and the emitter of the transistor Q4. The second end of the resistor R12 is connected to the base of the transistor Q4 and one end of the resistor R1. The collector of the transistor Q4 is connected to a first end of the resistor R2 which, in turn, is connected to the gate of the transistor Q3, the collector of the transistor Q5 and the cathode of the diode D11. The second end of the resistor R2 is connected to a first end of the feedback resistor R4 and a first end of the resistor R3. The second end of the resistor R3 is connected to the base of the transistor Q5 and a first end of the resistor R7. The second end of the resistor R7 is connected to the negative rail 130. The source of the transistor Q3 is connected to the first end of the feed forward resistor R21 and a first end of the sense resistor R14. Finally, the emitter of the transistor Q5 is connected to the anode of the diode D11 and the negative voltage rail 130.

The Boost Control Stage 145 controls the Boost Stage 140 operation and has several functions. The circuit is comprised of a voltage divider formed by the resistors R19 and R21, the sense Resistor R14, and the transistor Q8. When the ballast circuit 40 first starts, there is a current pulse which charges the boost inductor L2-1. This current pulse would cause the inductor L2-1 to saturate if action were not taken to prevent this condition. The transistor Q8 reads the voltage across the resistor R14 and through the voltage divider formed by the resistors R19 and R21 applies the signal to the base of the transistor Q8. When the voltage across the resistor R19 exceeds 0.7 volts, the transistor Q8 begins to turn on. This turns off the transistor Q2 which, in turn, instantaneously turns off the transistor Q3, thereby preventing the saturation of the boost inductor L2-1. If the inductor L2-1 were to saturate, it could destroy the transistor Q3. This circuit anticipates the saturation of the boost inductor L2-1 before saturation occurs.

The boost control stage 145 also performs power factor control and improves the total harmonic distortion, THD, by clamping the current level generated by the boost inductor L2-1 and preventing it from operating in the nonlinear region. This makes the input current to the boost converter stage 140 more sinusoidal. Additionally, the distortion at the zero crossing is controlled through the choice of the capacitor C3. The current must be limited to supply only that amount required to eliminate the null at the zero crossing. This further improves the power factor and the THD.

The second end of the resistor R14 is connected to the negative voltage rail 130. The second end of the resistor R21 is connected to a first end of the resistor R19 and the base of the transistor Q8. The second end of the resistor R19 is connected to the negative voltage rail 130. The collector of the transistor Q8 is connected through feed forward link 56 to the base of the transistor Q2, the collector of the transistor Q6, a first end of the base supply capacitor CB2, and first ends of the resistors RB2 and R9.

With further reference to FIG. 2, the Modified Self Resonant Load Driving Stage 150 includes an active circuit to convert high voltage DC to high frequency, high voltage AC, a phase control transistor to control the phase of one half cycle for the purpose of dimming, working in concert with the series resonant drive components to apply the starting and operating voltages to the lamp load and the lamp load control stage 190 which controls the startup and end of life scenarios.

The Modified Self Resonant Load Driving Stage 150 receives the uniform DC voltage from the capacitor C02. The voltage across the capacitor C02 is measured between the circuit junction 148 and the negative voltage rail 130. The Modified Self Resonant Load Driving Stage 150 comprises transistors Q1 and Q2, diodes D7–D10 and D20, resistors R5, R8, R9, RB1 and RB2, capacitors C5,C6,CB1, CB2, and CS, and an inductor LR-1.

The transistors Q1 and Q2 are connected as a half-bridge inverter. The collector of the transistor Q1 receives the DC voltage from the circuit junction 148. The collector of the transistor Q1 is also connected to the cathode of the diode D7 and to one terminal of the resistor R8. The emitter of the transistor Q1 is connected to the anode of the diode D7, to one terminal of the capacitor C5, to one terminal of the capacitor CB1, to the cathodes of the diodes D8, D10 and D20, to the collector of the transistor Q2, and to a tap 154 between a first section 152 and a second section 156 of the inductor LR-1. The base of the transistor Q1 is connected to a second terminal of the capacitor CB1, a second terminal of the resistor R8, the anode of the diode D20, and one terminal of the resistor RB1. A second terminal of the resistor RBI is connected to a first terminal of the first section 152 of the inductor LR-1.

As discussed above, the collector of the transistor Q2 is connected to the emitter of the transistor Q1, and therefore is also connected to all of the components connected to the emitter of the transistor Q1. The emitter of the transistor Q2 is connected to the negative voltage rail 130. The base of the transistor Q2 is connected to one terminal of the resistor R9, to one terminal of the capacitor CB2, to one terminal of the resistor RB2, and to the collector of the transistor Q6. A second terminal of the capacitor CB2 is connected to the minus voltage rail 130. A second terminal of the resistor R9 is connected to one terminal of the diac D9. A second terminal of the diac D9 is connected to the anode of the diode D8, to one terminal of the capacitor C6, and to one terminal of the resistor R5. A second terminal of the resistor R5 is connected to the circuit junction 148. A second terminal of the capacitor C6 is connected to the negative voltage rail 130. The negative voltage rail 130 is also connected to the anode of the diode D10.

The second section 156 of the inductor LR-1 is connected to one terminal of a capacitor CS. A second terminal of the capacitor CS is connected to a first filament terminal 161. The capacitor CS is a DC blocking capacitor.

Prior to the lamp striking, the capacitor C6 is charged through the resistor R5. When the voltage across the capacitor C6 reaches a preset limit, (approximately 32 volts in the preferred embodiment), it will fire the diac D9. Once fired, the diac D9 provides a path for the energy stored in the capacitor C6 to be transferred into the base of the transistor Q2. This energy turns on the transistor Q2. Before turning on the transistor Q2, the capacitor CS is charged via the resistor R8, the resistor RBI and the second section 156 of the inductor LR-1. However, after the transistor Q2 is activated, the current through the resistors R8 and RB1 flows through the first section 152 of the inductor LR-1, through the collector of the transistor Q2 to the emitter of the transistor Q2 to the negative voltage rail 130. Also, the energy stored in the capacitor CS is now provided to the collector of the transistor Q2 through the second section 156 of the inductor LR-1. However, after the transistor Q2 is activated, the current through the resistors R8 and RB1 flows through the first section 152 of the inductor LR-1, through the collector of the transistor Q2 to the emitter of the transistor Q2 to the negative voltage rail 130. Also, the energy stored in the capacitor CS is now provided to the collector of the transistor Q2 through the section 156 of the inductor LR-1. This causes the energy stored in the capacitor CS to be discharged by the transistor Q2 via the second section of the inductor LR-1. Because the capacitors CR1 and CS are connected in series with the inductor LR-1, the circuit will begin to resonate. The energy stored in the capacitors CR1 and CS is then discharged in a resonating mode via the resonating elements, the capacitor CR and the inductors LR-1, LR-4, and LR-3. This creates a trapezoidal wave type of resonating signal that will alternatively drive the transistors Q1 and Q2 to maintain this oscillating (i.e., resonating) process.

Because a higher than normal voltage is applied using this resonating technique, the lamps 14 and 16 will be lit that are reaching the end-of-life state. This extends the practical useful life of a fluorescent lamp. Also, the higher voltage allows the lamps to be struck at lower temperatures. The present invention will strike a lamp in weather as cold as −20° C.

The transistor Q1 will turn on when there is a positive polarity across the first section 152 of the inductor LR-1. Inductors LR-1, LR-2, LR-3 and LR-4 share the same ferromagnetic core and have mutual inductance. As indicated by the dots, the inductor LR-2, which is the driving section for the transistor Q2, is opposite in polarity from the first section 152 of the inductor LR-1. Because of the opposite polarity, the transistors Q1 and Q2 can never be on at the same time. If the transistors Q1 and Q2 were to turn on at the same time, they would create a cross conduction current which would short circuit capacitor C02.

The circuit in FIG. 2 has connections for two fluorescent lamps. A first filament terminal 161 and a second filament terminal 162 connect a first filament A. A third filament terminal 165 and a fourth filament terminal 167 connect a second filament B. A fifth filament terminal 169 and a sixth filament terminal 171 connect a third filament C. A seventh filament terminal 173 and an eighth filament terminal 175 connect a fourth filament D.

In two-lamp operation, the first fluorescent lamp 14 (FIG. 2) is connected between the first and the second filament terminals 161, 162 and the third and fourth filament terminals 165, 167. The second fluorescent lamp 16 (FIG. 2) is connected between the fifth and sixth filament terminals 169, 171 and the seventh and eighth filament terminals, 173, 175.

In two-lamp operation, the first fluorescent lamp 14 (FIG. 2) is connected between the first and second filament terminals 161, 163 and the third and fourth filament terminals 165, 167. The second fluorescent lamp 16 (FIG. 2) is connected between the fifth and sixth filament terminals 169, 171 and the seventh and eighth filament terminals 173, 175.

Figure 3A:
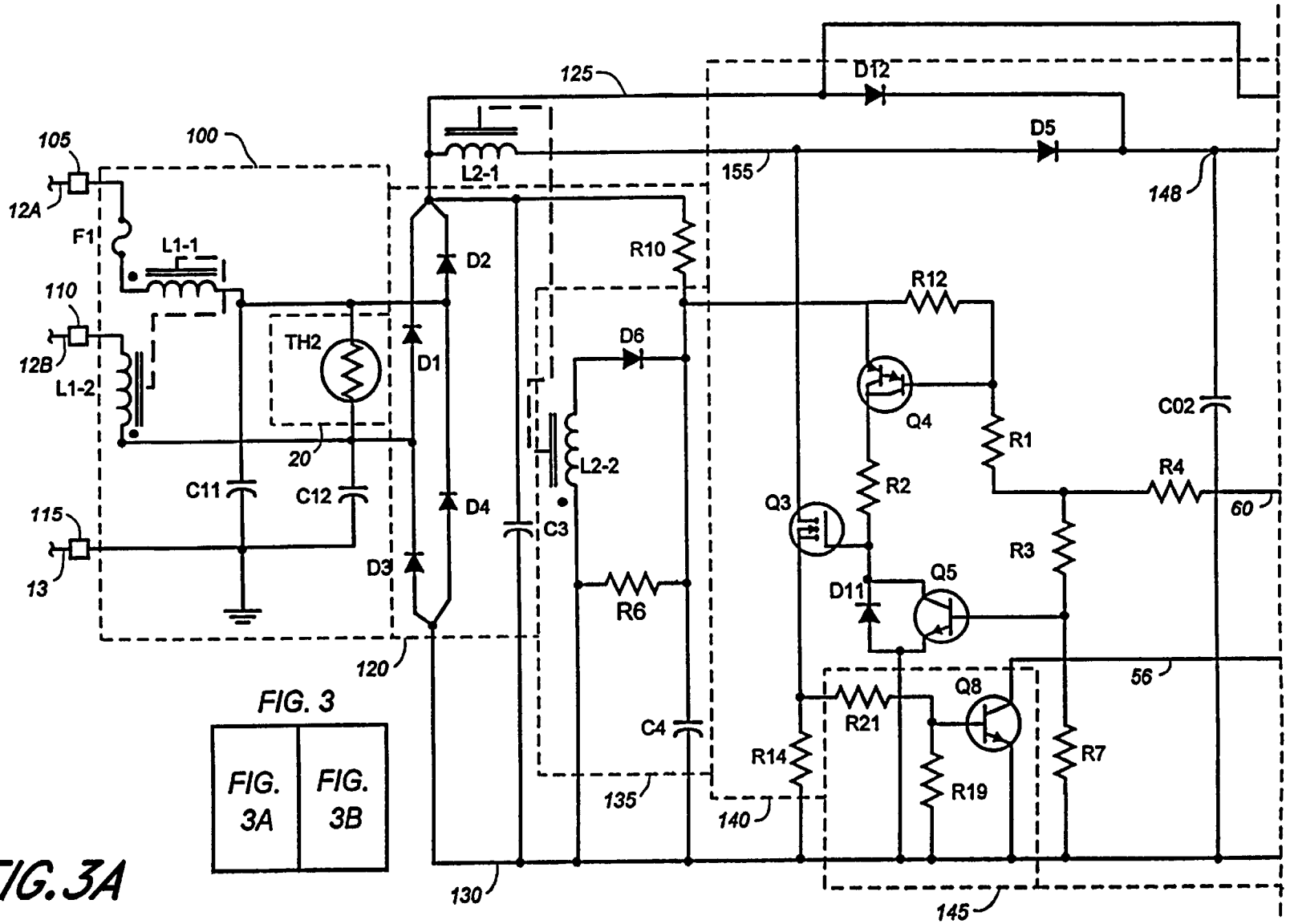
FIG. 3 is a schematic circuit illustration of the ballast circuitry of FIG. 1, showing a single lamp fluorescent lamp load.

For one-lamp operation, the first fluorescent lamp 14 (FIG. 3) is connected between the first and second filament terminals 161, 163 and the third and fourth filament terminals 165, 167, and the other filament terminals are not used. The first filament terminal 161, is connected to a first terminal of inductor LR-4, while the second terminal of inductor LR-4 is connected to the second filament terminal 163. The second filament terminal 163, is connected to one terminal of the inductor LR-3. A second terminal of the inductor LR-3 is connected to a first terminal of the capacitor CR1. A second terminal of the capacitor CR1 is connected to a third filament terminal 165. The fourth filament terminal 167 is connected to the minus voltage rail 130.

When in two-lamp operation, the second end of capacitor C10, the fourth filament terminal 165 and the sixth filament terminal 169 are connected to one terminal of the inductor LR-3. A second terminal of the inductor LR-3 is connected to the third filament terminal 167 and the fifth filament terminal 171 to connect the filaments B and C in parallel. In two lamp operation, the first lamp 14, having filaments A and B, is connected in series to the second lamp 16, having filaments C and D. Alternatively, the inductor LR-5 may be placed in series with the capacitor CR1 to provide split inductor operation. In this configuration, the jumper 206 is replaced with the inductor LR-5. Additionally, jumpers 202 and 206 permit the switching of lamp warming between voltage and current modes. With the jumpers in place the warming cycle operates in voltage mode and with the jumpers absent, the warming cycle utilizes current mode.

Figure 3B:
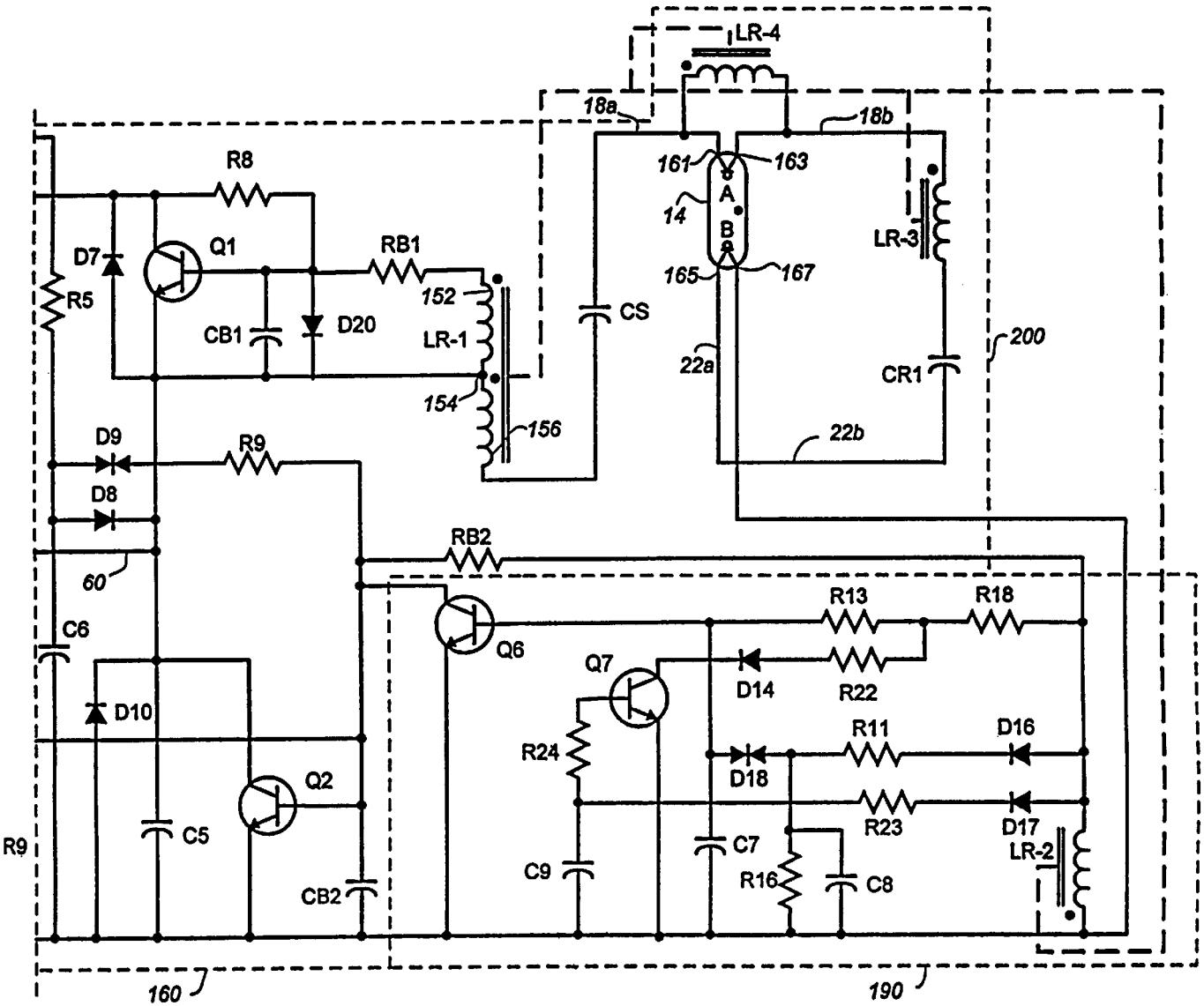

The one lamp circuit configuration shown in FIG. 3B causes the lamp to work as a switch. Before the lamp strikes, when power is first applied to the circuit, the second section 156 of the inductor LR-1, the capacitor CS, the filament A, the inductor LR-3, the capacitor CR1 and the filament B are in series when the transistor Q1 turns on. Thus, the impedance is determined in part by the series combination of the second segment 156, the inductor LR-3, and the capacitor CR1. The cold (unstruck) lamp presents a very high impedance to the circuit. The resonant frequency of the circuit of determined by the combined series inductance of the second section 156 of inductor LR-1 and the inductor LR-3.

After the lamp strikes, the impedance of the lamps is reduced to a few hundred ohms. In the preferred embodiment, this impedance will be between 200 and 500 ohms. In this state, the inductor LR-1 is the new resonating inductor and the load will be connected in parallel to the inductor LR-3 and the capacitor CR1. Before striking, the resonating inductance is the series combination of the inductors LR-1 and LR-3. After striking the lamp, the struck lamp impedance effectively shunts the series combination of LR-3 and CR1. In the preferred embodiment, after the lamps strike the series inductance is cut by approximately 40 percent. This occurs because the inductance is the square of the number of turns of wire on the inductor. Before striking, there are 220 turns of wire on the second section of the inductor LR-1 and 60 turns of wire on the inductor LR-3 for a total of 280 turns of wire. After the lamp strikes, the resonating inductor is only the 220 turn section of the inductor LR-1. The ratio between the square of 280 turns and the square of 220 turns is 1.6:1.0 and reduces the post-strike inductance to approximately 62% of the original inductance.

There are several advantages to this method of having the striking lamp switch the inductance out. First, near the end of the lamp's life, the lamp may have good filaments but not strike. This causes the impedance of the circuit to stay high. In this situation, a high inductance is desirable because a large impedance lowers the current. When the lamp strikes, a lower impedance is desired in order to efficiently transfer power. Also, prior to the lamp striking, the circuit tends to operate at a higher frequency, and the circuit is designed in a way to create a local resonance, so that before the lamp strikes, the impedance of the combination of the inductor LR-3 and the capacitor CR1 is going to be lower than the capacitor CR1 only. Because of this low impedance, there is a higher current flowing into the first and second filament terminals 161, 162 and the third and fourth filament terminals 165 and 167. This high current is desirable prior to lamp striking in order to preheat the filament. After the lamp strikes, the impedance of the inductor LR-3 and the capacitor CR1 together is going to be higher than the impedance of the capacitor CR1 only. This is because the frequency shifts downwards and moves away from the local resonance after the lamp strikes. This reduces the current on the filaments of the lamps and increase the overall efficiency of operations. Therefore, prior to the lamp striking a series resonating circuit comprises the inductors LR-1 and LR-3 and the capacitor CR1 all connected in series. After the lamp strikes, the inductor LR-1 is connected in series with the load, and the load is connected in parallel to the inductor LR-3 and the resonating capacitor CR1, creating a complex resonating circuit. However, the impedance of the lamp is sufficiently lower than the impedance of the series combination of the inductor LR-3 and the capacitor CR1 such that the series combination is effectively out of the circuit.

If there are no lamps in the circuit so that the capacitors CS and CR1 and the inductors LR-1 and LR-3 are connected in series, the diac D9 will not fire. The charge across the capacitor C6 will continue to attempt to fire the diac D9 until a lamp is inserted. Once the diac D9 is fired and the transistor Q2 turns on, any charge in the capacitor C6 will be drained via the diode D8 through the collector of the transistor Q2.

The final section of the circuit is a lamp load control stage 190. The lamp load control stage 190 includes transistors Q6 and Q7, capacitors C7, C8 and C9, an inductor LR-2, resistors R11, R13, R16, R18, F22, R3 and R24, diodes D14, D16 and D17, and a diac D18. As discussed above, the collector of the transistor Q6 is connected to one terminal of the resistor RB2, to a second end of the resistor R9, to the base of the transistor Q2, and to one terminal of the capacitor CB2. The emitter of the transistor Q6 is connected to the minus voltage rail 130. The base of the transistor Q6 is connected to one terminal of the resistor R13, to one terminal of the diac D18, and to one terminal of the capacitor C7. A second terminal of the capacitor C7 is connected to the minus voltage rail 130. A second end of the resistor R13 is connected to a first end of the resistors R18 and R22. The second end of the resistor R13 is connected to a second terminal of the resistor RB2, to the anode of the diode D16, to the anode of the diode D17, and to one terminal of the inductor LR-2. A second terminal of the inductor LR-2 is connected to the minus voltage rail 130. The cathode of the diode D16 is connected to a first end of the resistor R11. The second end of resistor R11 is connected to the second end of the diac D18 and the first end of the parallel combination of the resistor R16 and the capacitor C8. The second end of the resistor R22 is connected to the anode of the diode D14. The cathode of the diode D14 is connected to the collector of the transistor Q7. The first end of the resistor R24 is connected to the base of the transistor Q7. The second end of the resistor R24 is connected to a first end of the capacitor C9 and a first end of the resistor R23. The second end of the resistor R23 is connected to the cathode of the diode D17. The second end of the capacitor C9 is connected to the negative voltage of rail 130.

The lamp load control stage 190 controls the three phases of lamp load operation. These phases are the filament warming, lamp load starting, and lamp load operating phases. There are conditions that must be met when starting the lamp. The first is that the voltage applied to the load must be less than the break down voltage of the lamp (i.e., the voltage at which the vapor ionizes and the lamp begins to glow). The break down voltage is defined by the lamp glows current and must be less than or equal to 25 milliamperes RMS. Finally, the glow current must be supplied for at least 0.5 seconds and less than or equal to 1.5 seconds. Diodes D14, D16 and D17 assure that the lamp load control stage 190 operates only during the positive half cycle. When the ballast circuit starts, the capacitor C9 is uncharged and therefore current is not supplied to the base of the transistor Q7 with the result that the transistor Q7 is turned off. The transistor Q7 controls a voltage divider network defined by the resistors R13, R18 and R22. As a result, the full current from the inductor LR-2 is supplied to the base of the transistor Q6 through the resistors R13 and R18 which turns on the transistor Q6 and quickly turns off the transistor Q2, thereby severely truncating the on time of the transistor Q2. This supplies a filament warming current for the specified time to the lamp load.

During the next operating phase the transistor Q7 turns on, defined by the time constant established by the resistor R24 and the capacitor C9. The transistor Q7 starts acting as a voltage divider and supplies a lower base current to the transistor Q6 thereby extending the phase angle of the transistor Q6. The increased time of the transistor Q6 causes the high voltage supplied to the lamp load to rise due to a decrease in frequency and in conjunction with the warmed filament, as previously discussed, the lamp is struck. The striking voltage will be supplied for a time defined by the resistor R11 and the capacitor C7. When the lamp is struck the voltage across section 156 of the inductor LR-1 will increase as will the voltage across the magnetically coupled inductor LR-2. This will serve to maintain the charge on the capacitor C9 and insure the continued supply of the proper operating high frequency voltage to the lamp load and prevent the circuit from chattering.

If the lamps do not strike, the voltage supplied by the inductor LR-2 will continue to climb until it reaches the breakdown voltage of the diac D18. This will charge up the capacitor C7 and turn on the transistor Q6 which will turn off the transistor Q2. The transistor Q2 will remain off for a time defined by the resistor R5 and the capacitor C6 and the entire cycle will start from the beginning until the lamp load strikes.

Having thus described the operation of each of the ballast circuit sections the operation of the circuit as a whole will be discussed. It should be noted that the output circuit self resonates at a frequency which is inversely proportional to the voltage. Therefore as the frequency increases the power decreases. The duty cycle self controls by changing the conduction phase angle of the transistor Q2. When power is first applied to the main terminals 105 and 110, the circuit starts in a continuous mode with the capacitor C9 of the Modified Self Resonant Load Driving Stage 150 in the discharged condition and the transistor Q7 in the off state. The available voltage across the inductor LR-2 is applied to immediately switch control the transistor Q6 on through the divider network defined by the resistors R13 and R18 and the capacitor C7. This limits the power supplied to the lamp load and provides a warming current to the filaments for a period wherein $0.5 \leqq t \leqq 1.5$ seconds. This time constant is set by the capacitor C9 and the resistor R23. The power to the lamps will be lower also due to the higher frequency dictated voltage across the inductor LR-2. When the capacitor C9 charges to an appropriate value, the transistor Q7 will be turned on and will shunt part of the positive wave to the base of the transistor Q6 which will open the conduction angle with the phase angle being controlled by the capacitor C9 and the resistor R23. This will start to increase the voltage supplied to the lamp load and rapidly increase the voltage across the inductor LR-2 and the rate at which the capacitor C9 charges. This will strike the lamps. Should the lamps fail to strike, the voltage across the inductor LR-2 will continue to rise and when it reaches the break down voltage of the diac D18, the transistor Q6 will be turned on and the transistor Q2 will be turned off. This will immediately stop the circuit. The voltage across the inductor LR-2 will collapse. The circuit will now restart in a burst mode where a rapid sequence of pulses will be supplied to the lamp due to the fact that the capacitor C9 is already charged. This sequence will continue until either the lamps light or the condition is removed by removing the lamp. Removing the lamp will cause the circuit to stop oscillating and thereby cease operation.

The remainder of the operation has been previously discussed and as such numerous variations and modifications of the invention will become readily apparent to those skilled in the art. Accordingly, the invention may be embodied in other specific forms without departing from its spirit or essential characteristics. The detailed embodiment is to be considered in all respects only as illustrative and not restrictive and the scope of the invention is, therefore, indicated by the appended claims rather than by the foregoing description. All changes which come within the meaning and range of equivalency of the claims are to be embraced within their scope.

What is claimed is:

1. A dimming fluorescent lamp ballast which provides a lamp starting scenario to strike one or more lamps, said ballast comprising:

an AC voltage input stage;

a voltage rectifier stage;

a Boost Converter stage;

a boost control stage;

a modified self-resonant load driving stage which converts an amplified DC voltage to a high frequency AC signal suitable for striking and operating a lamp load;

a lamp load control stage, wherein;

said lamp load control stage executes said lamp starting scenario upon first receiving an input voltage wherein a voltage across a lamp load control stage inductor sets the phase angle to approximately zero of a half wave of said high frequency AC signal thereby applying a lamp filament warming current to said lamp load;

said lamp load control stage upon supplying said lamp filament warming current to said lamp load at a voltage below a striking voltage and sensing an increased voltage across said lamp load control stage inductor, controllingly increases a phase angle of a transistor which applies power to said lamp load; and said increased phase angle lowers the frequency and raises a voltage of the AC signal applied to the lamp load thereby applying a high voltage lamp load striking signal through said modified self-resonant load driving stage;

a load stage which receives a sequence of voltage pulses to strike one or more of said lamps, wherein;

said lamp load control stage reduces said high frequency high voltage lamp load striking signal to a lower level high voltage lamp load operating signal upon ignition of said lamp load stage;

said lamp load control stage upwardly adjusts a voltage of said high frequency high voltage lamp load striking signal based upon a failure of said lamp load stage to strike;

said lamp load control stage disables operation of said fluorescent lamp ballast for a quiescent time and then repeats the striking cycle until the lamp load stage ignition occurs; and said striking cycle provides protection against a missing lamp load and against a failed lamp load stage filament.

2. The ballast of claim 1, wherein said half wave is a positive half wave.

3. The ballast of claim 1, wherein said modified self-resonant load driving stage comprises:

a first input terminal and a second input terminal which receive an input voltage;

a first inductance having a first terminal and a second terminal, wherein the first terminal of said first inductance is coupled to said first input terminal;

a second inductance having a first terminal and a second terminal, wherein said first terminal of said second inductance is coupled to said second terminal of said first inductance, wherein one or more of said lamps are connected between said first terminal of said second inductance and said second input terminal; and a capacitance coupled between said second terminal of said second inductance and said second input terminal.

4. The ballast of claim 1, wherein said sequence of voltage pulses applies a high voltage across said lamps, thereby striking said lamps near an end-of-life state.

5. The ballast of claim 1, wherein said sequence of voltage pulses applies a high voltage across said lamps, thereby striking lamps in weather as cold as −20° C.

6. A dimming fluorescent lamp ballast wherein a synchronizing feedback signal synchronizes the operation of the boost converter stage with the on-off state of a modified self-resonant load driving stage, said ballast comprising:

an AC voltage input stage;

a voltage rectifier stage;

the Boost Converter stage;

the boost control stage;

a modified self-resonant load driving stage which converts an amplified DC voltage to a high frequency AC signal suitable for striking and operating a lamp load; and a lamp load; control stage;

wherein;

said synchronizing feedback signal is responsive to the duty cycle of the modified self-resonant load driving stage and feeds forward the power required by the load to maintain stable operation during dimming;

said modified self-resonant load driving stage is responsive to the output power of the boost converter stage, wherein the duty cycle increases as a voltage across a DC rail decreases and the duty cycle decreases as the voltage across the DC rail increases; and said modified self-resonant load driving stage applies a high voltage AC power level to a lamp load proportional to said voltage across the DC rail.

7. The ballast of claim 6, wherein said boost control stage assures continuous operation of an SCR dimming control over an entire dimming range and eliminates lamp flicker by filtering DC ripple from a rectified DC input;

said boost control stage additionally assuring that a boost inductor does not saturate;

said boost control stage turning off a stage synchronizing transistor in the self-resonant load driving stage which, in turn, turns off a switching transistor in the boost converter stage;

said boost control stage performing power factor and total harmonic distortion control by peak limiting an output voltage of a boost inductor to the linear region;

said boost converter stage having a diode providing path to a storage capacitor for protecting against line and start-up surge; and said diode providing path conducting excess voltage from the boost converter to said capacitor when operating at approximately fifty percent duty cycle in a continuous rode on alternate half cycles.

8. The ballast of claim 6, wherein a positive temperature coefficient thermistor is placed across the AC input to assure sufficient current draw and continuing operation of an SCR dimming control at low dimming settings.

9. The ballast of claim 6, wherein;

said lamp load control stage strikes the lamps upon first receiving an input voltage wherein a voltage across a lamp load control stage inductor sets the phase angle to approximately zero of a half wave of said high frequency AC signal, thereby applying a lamp filament warming current to said lamp load;

said lamp load control stage, upon supplying said lamp filament warming current to said lamp load and sensing an increased voltage across said lamp load control stage inductor, controllingly increases a phase angle of a transistor which applies power to said lamp load;

said increased phase angle lowers the frequency and raises a voltage of the AC signal applied to the lamp load, thereby applying a high voltage lamp load striking signal through said modified self-resonant load driving stage;

a load stage receives a sequence of voltage pulses to strike one or more of said lamps;

said lamp load control stage reduces said high frequency high voltage lamp load striking signal to a lower level high voltage lamp load operating signal upon ignition of said lamp load stage; and said lamp load control stage upwardly adjusts said high frequency high voltage lamp load striking signal based upon a failure of said lamp load stage to strike;

said lamp load control stage disables operation of said fluorescent lamp ballast for a quiescent time and then repeats the striking cycle until the lamp load stage ignition occurs;

said striking cycle provides protection against a missing lamp load and against a failed lamp load stage filament.

10. The ballast of claim 9, wherein the warming current is selectable between voltage and current modes.

11. The ballast of claim 6, wherein said half wave is a positive half wave.

12. The ballast of claim 6, wherein said modified self-resonant load driving stage comprises:

a first input terminal and a second input terminal which receive an input voltage;

a first inductance having a first terminal and a second terminal, wherein the first terminal of said first inductance is coupled to said first input terminal;

a second inductance having a first terminal and a second terminal, wherein said first terminal of said second inductance is coupled to said second terminal of said first inductance, wherein one or more of said lamps are connected between said first terminal of said second inductance and said second input terminal; and a capacitance coupled between said second terminal of said second inductance and said second input terminal.

13. The ballast of claim 6, wherein said sequence of voltage pulses applies a high voltage across said lamps, thereby striking said lamps near an end-of-life state.

14. The ballast of claim 6, wherein said sequence of voltage pulses applies a high voltage across said lamps, thereby striking lamps in weather as cold as −20° C.

15. A method of striking one or more lamps in a fluorescent lamp ballast, the method comprising the steps of:

receiving a high frequency AC signal;

applying the AC signal to one or more of said lamps to warm said lamps;

decreasing the frequency and increasing the voltage of the AC signal applied to one or more of said lamps;

striking one or more of said lamps; and after striking said one or more of said lamps decreasing the voltage of the AC signal to a stable operating range.

16. The method of claim 15 further comprising the step of increasing the voltage of the AC signal upon failure to strike one or more of said lamps.

* * * * *

UNITED STATES PATENT AND TRADEMARK OFFICE

CERTIFICATE OF CORRECTION

PATENT NO. : 6,037,722
DATED : March 14, 2000
INVENTOR(S) : Mihail S. Moisin

It is certified that error appears in the above-identified patent and that said Letters Patent is hereby corrected as shown below:

Column 14, claim 7,
Line 51, change "rode on" to -- mode on --.

Signed and Sealed this

Twenty-seventh Day of November, 2001

*Attest:*

Nicholas P. Godici

NICHOLAS P. GODICI
*Acting Director of the United States Patent and Trademark Office*

*Attesting Officer*